US009629446B2

(12) United States Patent
Moreau et al.

(10) Patent No.: US 9,629,446 B2
(45) Date of Patent: Apr. 25, 2017

(54) TOOL POUCH WITH RETRACTORS

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/856,665

(22) Filed: Sep. 17, 2015

(65) Prior Publication Data

US 2017/0079414 A1 Mar. 23, 2017

(51) Int. Cl.

| | |
|---|---|
| ***A45C 15/00*** | (2006.01) |
| ***A45F 5/00*** | (2006.01) |
| ***A45F 5/10*** | (2006.01) |

(52) U.S. Cl.

CPC ..... *A45F 5/004* (2013.01); *A45F 5/102* (2013.01)

(58) Field of Classification Search

CPC ..... A45F 5/004; A45F 5/102; A45F 5/021
USPC ..... 224/162, 575, 904
See application file for complete search history.

(56) References Cited

U.S. PATENT DOCUMENTS 1,675,072 A * 6/1928 Watermon ..... A41D 13/04 2/48
5,251,743 A * 10/1993 Pulido ..... A45C 3/04 206/37.1
5,524,749 A * 6/1996 Thompson ..... A45F 5/02 150/147
5,653,337 A * 8/1997 Cirigliano ..... A45C 3/00 206/373
6,907,989 B2 * 6/2005 Ho ..... A45F 4/02 206/373
7,658,307 B2 * 2/2010 Skupin ..... A45F 5/004 224/219
8,411,849 B1 * 4/2013 McKenzie ..... H04B 1/3888 379/437
8,505,114 B1 * 8/2013 Earley ..... A45F 5/004 2/101
2002/0174521 A1 * 11/2002 Vidal, Jr. ..... A45F 5/004 24/3.1
2001/0099705 5/2004 Skupin
2005/0077329 A1 * 4/2005 Sconzo ..... A45F 3/04 224/153
2005/0115997 A1 * 6/2005 Nouvel De La Fleche ..... E05B 75/00 224/162

(Continued)

*Primary Examiner* — Adam Waggenspack
*Assistant Examiner* — Lester L Vanterpool
(74) *Attorney, Agent, or Firm* — Mesmer & Deleault

(57) ABSTRACT

A tool holder has a pouch with a front panel, back panel, and a closure that opens and closes access to an enclosed pouch compartment. The pouch has an outer tether opening from the pouch compartment to outside of the pouch. The pouch has a retractor pocket with a pocket opening to the outside and an inner tether opening to the pouch compartment. A retractable tether assembly is disposed in the retractor pocket with a tether extending into the pouch compartment via the inner tether opening and attaching to a closed loop connector at the distal tether end. The closed loop connector can be selectively decoupled from the distal tether end and is larger than the tether openings. Each retractable tether may be selectively configured to extend through an outer tether opening for connection to a hand tool located outside of the pouch when the pouch is closed.

8 Claims, 3 Drawing Sheets

(56) References Cited

U.S. PATENT DOCUMENTS

| | | | | |
|---|---|---|---|---|
| 2012/0168472 | A1* | 7/2012 | Mathews | A45F 3/14<br>224/162 |
| 2013/0181019 | A1* | 7/2013 | Salentine | A45F 5/00<br>224/242 |

* cited by examiner

TOOL POUCH WITH RETRACTORS

BACKGROUND OF THE INVENTION

1. Field of the Invention

The present invention relates generally to tool accessories and more particularly to a tool pouch with retractors.

2. Description of the Prior Art

Carpenters, electricians, facilities maintenance personnel, and other workers often use a tool belt or pouch to hold tools. One example is a lineman's pouch or the like that attaches to a tool belt and is designed to hold a small number of hand tools. Tool pouches of this type are useful for storing tools between tasks and help to prevent misplaced tools.

In addition to preventing misplaced tools, workers seek to avoid accidental drops, particularly when working on a ladder, scaffold, or other elevated location. Lanyards, tethers, hooks, and similar restraints have been used to prevent accidental drops. These restraints are particularly useful in environments where a tool drop can cause substantial damage or harm to plant equipment, workers, or objects below a worker who accidentally drops a tool. One method of restraining tools is to clip one end of a tether to the tool and to clip the other end of the tether to a tool belt or to a nearby structure. For smaller tools and smaller-capacity tool pouches, a tether sometimes gets in the way of using the tool or with placing the tool in the pouch.

One approach to solving this problem is described by Skupin in US published patent application no. 2004/0099705 for a tool carrier that can be carried next to a person's body and includes tapered slots to receive hand tools. The Skupin application discloses a tool carrier having a carrier body made of a sturdy material, such as coarse leather. A plurality of tool receptacles are attached to the front surface of the carrier body and arranged next to one another. Each tool receptacle is designed to hold one tool. A tether with a retractor device is provided for each tool receptacle. The retractor devices are contained in a compartment attached to the back surface of the carrier body and include a closable cover. Each tether extends through a hole in the carrier body for attachment to a tool.

SUMMARY OF THE INVENTION

The Skupin tool carrier has individual tool receptacles or slots arranged adjacent one another laterally across the face of a tool carrier body. However, the approach taken by Skupin is not optimal for a tool holder with a pouch compartment that is opened and closed and where the tool holder may also store tools outside of the pouch compartment on loops or external receptacles. Particularly, the Skupin pouch does not contemplate the user who wishes to use on occasion a tether connected to tools stored inside the pouch, and on other occasion the tether connected to tools stored on the outside of the pouch, where the pouch compartment may be either open or closed. For example, the user may store a tool in the pouch compartment when it is not in use, but prefer to temporarily store the tool in a slot or loop on the outside of the pouch when the tool is being used for a job. In such case, a tether extending through the pouch compartment would interfere with the pouch closure, which is inconvenient and could cause dropped tools. When the tether extends through the zipper, for example, the zipper may have to remain open. In this condition, the contents on the inside of the pouch are prone to falling out of the pouch, a situation sought to be avoided in the first place.

Also, for hammers or other tools stored in slots or loops on the outside surface of the pouch, the user needs to have the option of connecting a tether to these tools, but also have the ability to connect the tether to tools stored inside the pouch.

Thus, a need exists for an improved tool holder with one or more retractable tethers that may be connected to tools positioned either inside or outside of the pouch compartment.

Accordingly, it is an object of the present invention to provide a tool holder that enables a worker to connect a tether to a tool located either inside or outside of a closable pouch compartment without interference to the closure.

The present invention achieves these and other objectives by providing a tool holder with a closable pouch compartment and including at least one retractable tether usable with tools located either inside or outside the pouch compartment.

In one embodiment, a tool holder has a pouch enclosing a pouch compartment and having a holder front panel and a holder back panel. The pouch defines one or more outer tether opening from the pouch compartment to outside of the pouch. A releasable closure is installed between the holder front panel and the holder back panel and is configured to selectively open and close primary access to the pouch compartment. The pouch has at least one retractor pocket with a primary pocket opening to the outside and at least one inner tether opening to the pouch compartment. One or more retractable tether assemblies are disposed in the retractor pocket(s), each retractable tether assembly having a retractor body and a retractable tether with a distal tether end defining an end opening, where the retractable tether extends from the retractor body into the pouch compartment via an inner tether opening. A closed loop connector attaches through the end opening on the distal tether end of each retractable tether. The closed loop connector is configured to be selectively decoupled from the distal tether end and is larger than the inner tether openings and outer tether openings. Each inner tether opening and each outer tether openings are sized to permit passage of the retractable tether, yet prevent passage of the closed loop connector. Therefore, each retractable tether may be selectively configured to extend through an outer tether opening for use with a hand tool located outside of the pouch when the releasable closure closes the primary access to the pouch compartment.

In one embodiment, the pouch has a front retractor pocket on the front panel and a rear retractor pocket on the rear panel. In another embodiment, at least one retractable tether assembly is disposed in the front retractor pocket and at least one retractable tether assembly is disposed in the rear retractor pocket. In some embodiments, two or more retractable tether assemblies are disposed in a retractor pocket.

In some embodiments, a retractor pocket defines an inner tether opening for each retractable tether assembly disposed therein.

In another embodiment, the pouch includes a sidewall extending transversely between and connecting the holder front panel to the holder back panel, where the releasable closure is installed along the sidewall. In another embodiment, the sidewall includes at least one outer tether opening.

In another embodiment, the distal tether end includes a swivel connector that defines the end opening.

DETAILED DESCRIPTION OF THE PREFERRED EMBODIMENT

Figure 1:
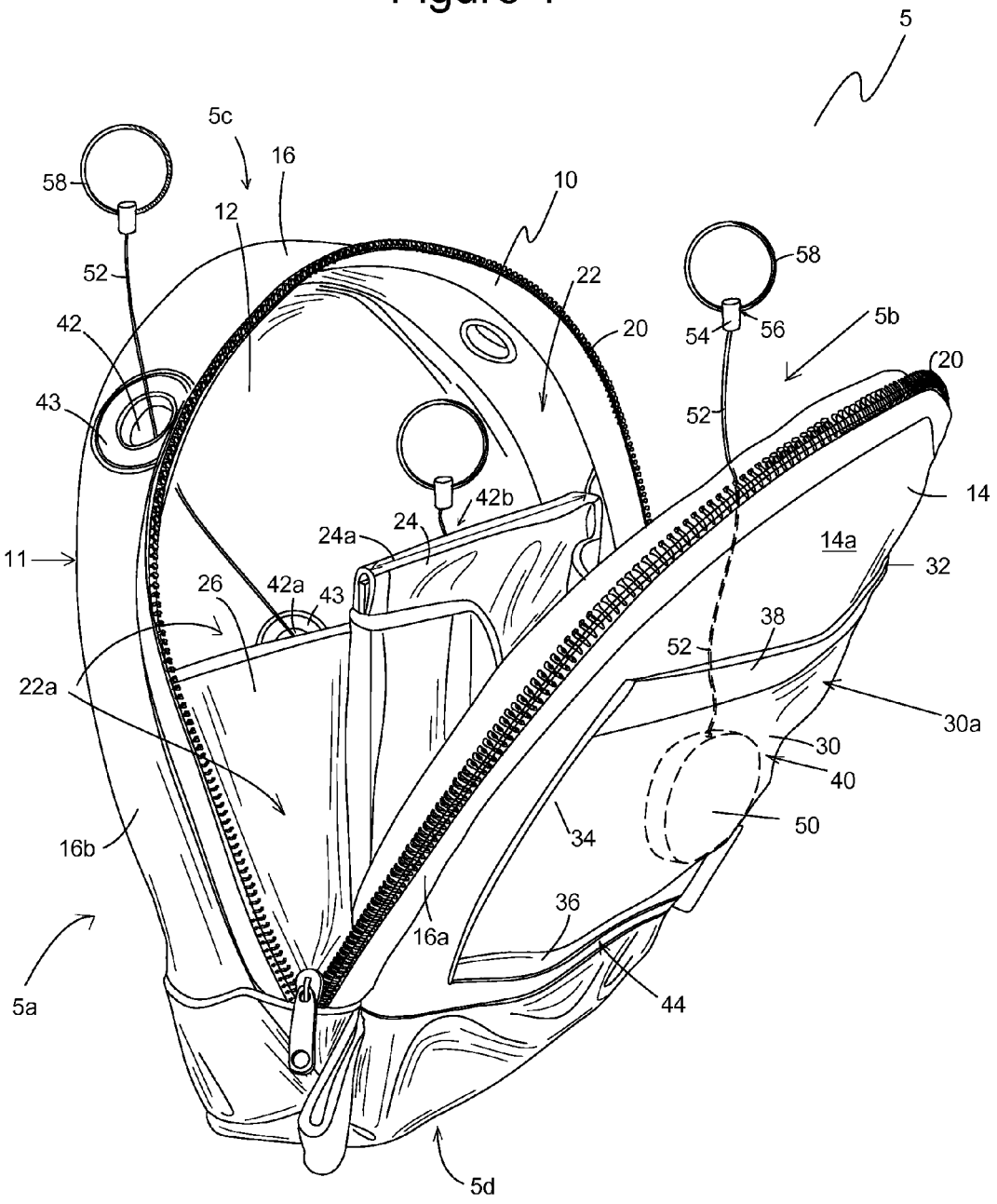
FIG. 1 is a front perspective view of one embodiment of a tool holder of the present invention showing the tool holder in an open configuration.
Figure 2:
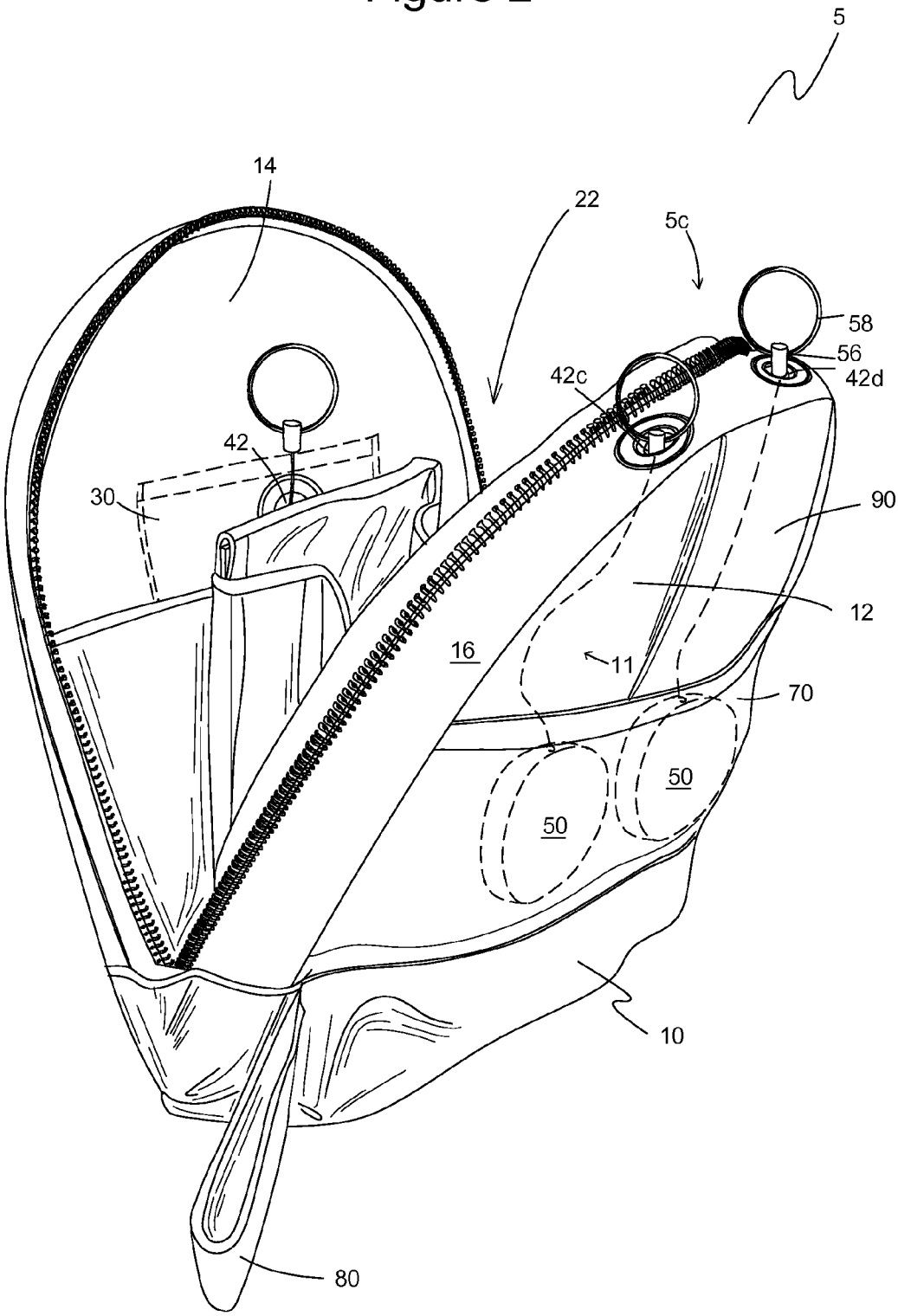
FIG. 2 is a back perspective view of the tool holder of FIG. 1 showing a rear retractor pocket attached to an outside surface of the holder rear panel.
Figure 3:
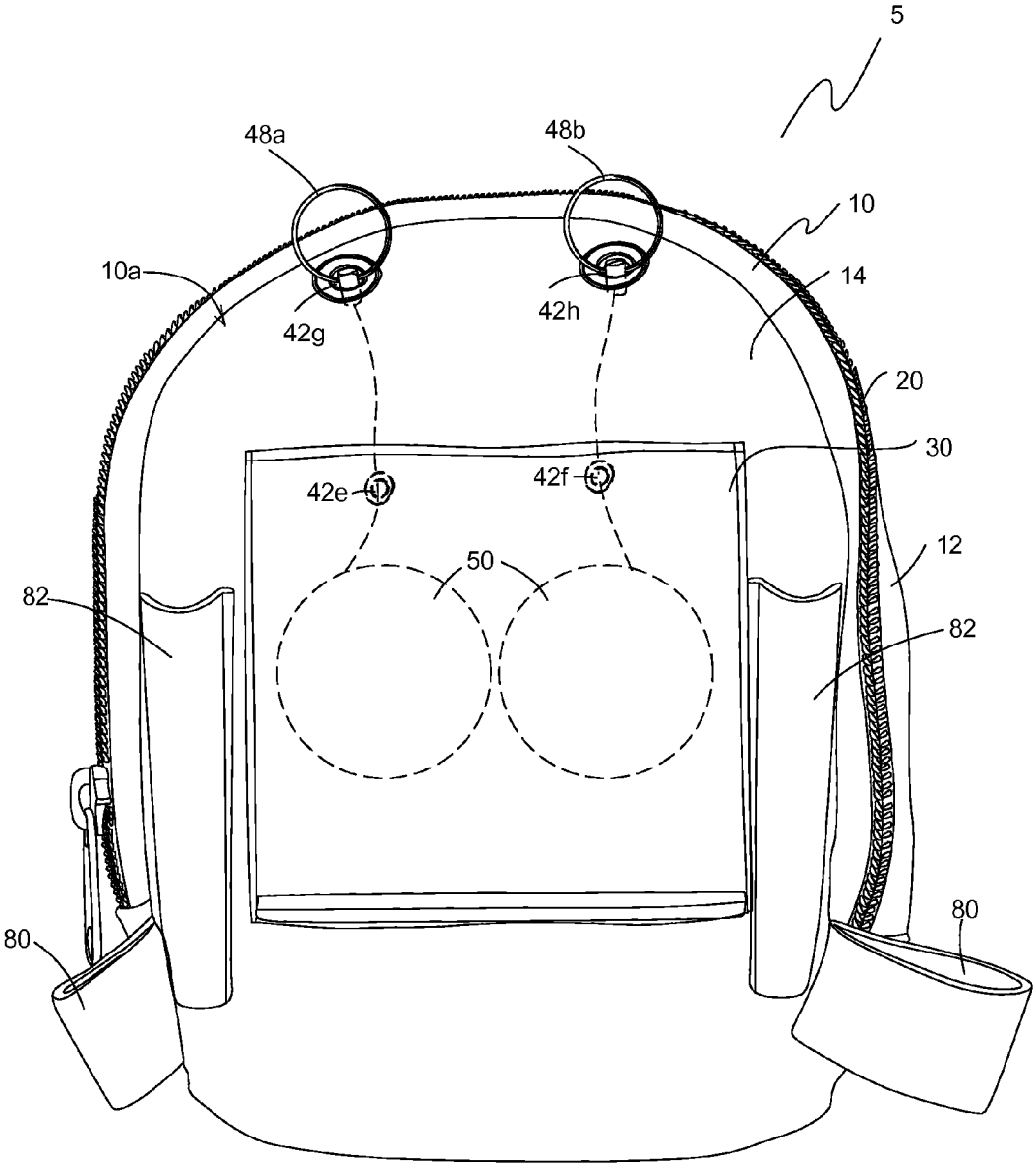
FIG. 3 is a front elevational view of another embodiment of a tool holder of the present invention showing tool loops and tool pockets on the outside surface.

The preferred embodiments of the present invention are illustrated in FIGS. 1-3. FIG. 1 illustrates a front perspective view of one embodiment of a tool holder 5 comprising a pouch 10 having a holder back panel 12, a holder front panel 14, and a holder sidewall 16 extending transversely between and connecting holder back panel 12 and holder front panel 14. Tool holder 5 preferably made of pliant material, such as a textile made with synthetic or natural fibers, leather, Cordura®, plastic, or the like. When tool holder 5 is made of a fabric, it optionally has a waterproof and/or wear-resistant backing.

Sidewall 16 includes a closure 20 extending along a first side portion 5*a*, a second side portion 5*b*, and a top portion 5*c* of tool holder 5. Typically, closure 20 does not extend along floor portion 5*d* of tool holder 5 although such an embodiment is contemplated within the scope of the invention. In one embodiment, closure 20 is a zipper; however, other closures are acceptable. Closure 20 is operable between an open position and a closed position, where tool holder 5 can fold open when closure 20 is in the open position. In the closed position of closure 20, sidewall 16, holder front panel 14, and holder back panel 12 enclose a pouch compartment 22, with holder front panel 14 spaced apart from and substantially parallel to holder back panel 12.

In some embodiments, closure 20 is located along sidewall 16 part way between holder back panel 12 and holder front panel 14, thereby defining a first sidewall portion 16*a* connected to holder front panel 14 and a second sidewall portion 16*b* connected to holder back panel 12. Although it is useful to construct tool holder 5 using a sidewall 16 for increased carrying capacity, it is contemplated that holder front panel 14 and holder back panel 12 may be joined along their respective edges without sidewall 16. In some embodiments, therefore, closure 20 extends along and is installed between holder front panel 14 and holder back panel 12.

In some embodiments, tool holder 5 includes one or more partition 24 located in pouch compartment 22 between holder back panel 12 and holder front panel 14. Each partition 24 is useful to divide pouch compartment 22 into separate areas or pouch sub-compartments for storing various tools. As shown in FIG. 1, partitions 24 includes side partitions 26 that extend between and connect holder front panel 14 to holder back panel 12 and also connect to partition 24 at its end. Side partitions 26 are made of flexible material that allows them to open and fold closed as tool holder 5 opens and closes. When partition 24 has a partition width 24*a* that is less than that of pouch compartment 22, side partition 26 may define a smaller sub-compartment 22*a* within pouch compartment 22, where sub-compartment 22*a* is adjacent side portion 10*a* or 10*b*.

Holder front panel 14 has one or more front retractor pocket 30 with a front retractor pocket outside surface 30*a*, a front retractor pocket first side portion 32, a front retractor pocket second side portion 34, a front retractor pocket lower end portion 36, and a front retractor pocket upper end portion 38. In one embodiment, front retractor pocket 30 is a fabric panel that is attached to outside surface 14*a* of holder front panel 14 along two or more front retractor side portions 32, 34, 36, 38, thereby defining a retractor compartment 40. Front retractor pocket 30 is attached to holder front panel 14, for example, by stitching, rivets, snaps, buttons, adhesive, hook-and-loop fastener, or other means or a combination of means. In some embodiments, the fabric panel used to make front retractor pocket 30 is made of an elasticized or stretchable material, such as those containing natural or synthetic rubber. One example of an acceptable material is polychloroprene sold under the name Neoprene® by DuPont.

In one embodiment, at least one front retractor pocket side portion 32, 34, 36, 38 is releasably attached to outside surface 14*a* of holder front panel 14 using, for example, a hook-and-loop fastener, button(s), snap(s), zipper(s), or other means to define an opening 44 that is selectively closable by the user. When front retractor pocket 30 is selectively closable, the user can install or replace retractors 50 through opening 44 as needed. For example, opening 44 is along upper end portion 38 or lower end portion 36. Of course, in some embodiments, none of front retractor pocket side portions 32, 34, 36, 38 are openable by the user, where the manufacturer installs retractors 50 and permanently closes front retractor pocket 30 with retractor(s) 50 therein.

Front retractor pocket 30 is sized to house and retain one or more retractable tether assemblies or retractors 50 with a tether 52. Front retractor compartment 30 communicates with pouch compartment 22 via one or more tether openings 42 that extend through holder front panel 14 (not visible; shown in FIG. 2). Tether 52 extends from retractor 50 disposed in front retractor compartment 30, passes through tether opening 42, and into pouch compartment 22. Tether 52 may then be connected to a tool stored in pouch compartment 22 to prevent accidental tool drops. Although not visible in FIG. 1, each tether opening 42 for front retractor pocket 30 extends through holder front panel 14 to pouch compartment 22 similar to tether openings 42*a*, 42*b* shown in FIG. 1 for rear retractor pocket 70 (discussed below). In one embodiment, front retractor pocket 30 has at least one tether opening 42 for each retractor 50.

Each tether opening 42 may be a slit, hole, gap, or other opening sized for passage of tether 52. In one embodiment, tether opening 42 is defined by an eyelet or grommet 43 secured through the material of pouch 10. In one embodiment, grommet 43 has an opening of about ⅛ to ¼ inch in diameter.

Typically, retractor 50 is spring-loaded to automatically retract tether 52. However, in place of retractor 50, it is acceptable to place in front retractor pocket 30 an object that is larger than a front tether opening size 42*a* to anchor tether 52 to tool holder 5. For example, tether 52 connects to a washer, bar, block, or other item held within front retractor compartment 40. The user may manually retract tether 52 and replace it in retractor compartment 40 when work is complete for a tool attached to that particular tether 52.

Tether 52 has a distal tether end 54 that defines an end opening 56 through which closed loop connector 58 may be installed. In some embodiments, end opening 56 is defined by folding distal tether end 54 back on itself to form a loop and then installing a crimp. A D-ring, split ring, carabiner, or other closed-loop connector 58 then may be installed through end opening 56. In other embodiments, a swivel connector, cable end crimp, or the like is installed on distal tether end 54, where the connector or crimp includes end opening 56. In yet other embodiments, tether 52 is tied with distal tether end in a knot around closed loop connector 58, where the knot defines end opening 56. Other connectors and termination devices known in the art may be used.

Referring now to FIG. 2, a rear perspective view of tool holder 5 illustrates a rear retractor pocket 70 and belt loop 90 attached to holder rear panel 12 that forms pouch 10. Rear retractor pocket 70 is constructed similarly to front retractor pocket 30 as discussed above. Rear retractor pocket 70 as shown is sized to hold a plurality of retractable tether assemblies 50. Tethers 52 of each retractable tether assembly 50 of rear retractor pocket 70 extend into pouch compartment 22 via tether openings 42*a*, 42*b* (shown in FIG. 1), and then through tether openings 42*c*, 42*d* on top portion 10*c* of tool holder.

Each closed loop connector 58 is configured to be releasably attached to end opening 56 at distal tether end 54. As such, closed loop connector 58, which is larger than tether opening 42, may be removed to allow distal tether end 54 to pass through tether opening 42 so that the user may use tether 52 with tools stored within pouch compartment 22 or with tools stored outside pouch compartment 22, such as tools held in tool loop 80 or other location on the user. To provide tool holder 5 with this configuration flexibility, distal tether end 54 is typically sized smaller than tether opening 42. In other embodiments, distal tether end 54 has a changeable size, such as a loop formed by looping distal tether end 54 on itself to form end opening 56. In such an embodiment, end opening 56 tends to have a size that is greater than tether opening 42, but may be squeezed by the user to reduce its size to fit through tether opening 42. Thus, after removing closed loop connector 58, end opening 56 and distal tether end 54 may be passed through tether opening 42 to modify the configuration of tool holder 5 and to replace retractable tether assembly 50.

Referring now to FIG. 3, a front elevational view illustrates tool holder 5 with front holder panel 14 and rear panel holder 12 of pouch 10 held in a closed configuration by closure 20. As shown, front retractor pocket 30 contains two retractable tether assemblies 50, each having a tether 52 that extends through tether openings 42*e*, 42*f* into pouch compartment 22 and then through additional tether openings 42*g*, 42*h* to connect to closed loop connectors 48*a*, 48*b* on the outside of pouch 10. Tool holder 5 includes tool loops 80 and tool pockets 82 attached to an outside surface 11 of tool holder 5. Depending on the tools to be used and whether those tools will be accessed from inside or outside pouch compartment 22, the user may configure tool holder 5 so that any of closed loop connectors 48 are located inside or outside of pouch compartment 22 for the most convenient tethering configuration of a given situation.

In use, one or more tools (not shown) are stored in pouch compartment 22, such as between partition 24 and holder front panel 14 or holder back panel 12. Tools may alternately be stored in a tool loop 80 or tool pocket 82 attached to outside surface 11 of tool holder 5. Closed loop connector 58 of each retractable tether assembly 50 can be connected to a tool. The user may customize the location of each closed loop connector 58 as being inside pouch compartment 22 or extending through tether opening 42 so that it is located outside of pouch compartment 22. A plurality of tools can be stored in and around tool holder with each tool tethered to its own retractor 50. Therefore, accidental tool drops are prevented while also reducing entanglement of tethers 52 and other worker equipment. Therefore, worker efficiency and safety is improved while also providing a tool holder with retractable tethers that can be custom configured as desired.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tool holder comprising:

a pouch enclosing a closable pouch compartment between a holder front panel and a holder back panel, wherein the pouch compartment is configured to retain one or more hand tools accessible through a primary access along a top portion of the pouch, the pouch defining one or more outer tether openings from the pouch compartment to outside of the pouch;

a releasable closure installed along the top portion between the holder front panel and the holder back panel and operable between an open position and a closed position to selectively open and close the primary access to the closable pouch compartment;

at least one retractor pocket on the pouch, the retractor pocket having a primary pocket opening to the outside and at least one inner tether opening to an inside of the pouch compartment;

one or more retractable tether assembly disposed in the at least one retractor pocket, each of the one or more retractable tether assembly having a retractor body and a retractable tether with a distal tether end defining an end opening, wherein the retractable tether extends from the retractor body into the pouch compartment via the at least one inner tether opening; and a closed loop connector attached through the end opening on the distal tether end, wherein the closed loop connector is configured to be selectively decoupled from the distal tether end, and wherein the closed loop connector is larger than the at least one inner tether opening and the one or more outer tether openings;

wherein each of the at least one inner tether opening and each of the one or more outer tether openings are sized to permit passage of the retractable tether and prevent passage of the closed loop connector, and wherein each retractable tether may be selectively configured to extend through one of the one or more outer tether openings and attach to a hand tool located outside of the pouch when the releasable closure closes the primary access to the pouch compartment;

wherein the pouch is configured to store at least one hand tool in the closable pouch compartment with the at least one hand tool attached to the retractable tether when the releasable closure is in the closed position, and to permit removal of the at least one hand tool through the top portion of the pouch with the at least one hand tool attached to the retractable tether when the releasable closure is in the open position.

2. The tool holder of claim 1, wherein the at least one retractor pocket includes a front retractor pocket on the front panel and a rear retractor pocket on the rear panel.

3. The tool holder of claim 2 wherein the one or more retractable tether assembly includes at least one retractable tether assembly disposed in the front retractor pocket and at least one retractable tether assembly disposed in the rear retractor pocket.

4. The tool holder of claim 3, wherein each of the at least one retractor pocket defines an inner tether opening for the at least one retractable tether assembly disposed therein.

5. The tool holder of claim 1, further comprising:

a sidewall extending transversely between and connecting the holder front panel to the holder back panel, wherein the releasable closure is installed along a portion of the sidewall.

6. The tool holder to claim 5, wherein the sidewall includes at least one outer tether openings from the closable pouch compartment to an outside of the pouch.

7. The tool holder of claim 1, wherein the distal tether end comprises a swivel connector that defines the end opening.

8. The tool holder of claim 1, wherein the pouch defines one or more outer tether openings from the closable pouch compartment to an outside of the pouch.

* * * * *